United States Patent [19]

Knackstedt

[11] Patent Number: 4,955,779

[45] Date of Patent: Sep. 11, 1990

[54] CONNECTOR

[75] Inventor: Jack S. Knackstedt, London, United Kingdom

[73] Assignee: Jaromir Vaclav Drazil, Little Chalfont, United Kingdom

[21] Appl. No.: 215,066

[22] PCT Filed: Oct. 27, 1987

[86] PCT No.: PCT/GB87/00760

§ 371 Date: Aug. 3, 1988

§ 102(e) Date: Aug. 3, 1988

[87] PCT Pub. No.: WO88/03198

PCT Pub. Date: May 5, 1988

[30] Foreign Application Priority Data

Oct. 28, 1986 [GB] United Kingdom ..... 8625778

[51] Int. Cl.[5] ..... B66C 23/00; E02F 3/96

[52] U.S. Cl. ..... 414/723; 403/324; 137/595; 137/614.04

[58] Field of Search ..... 414/723; 403/324, 133, 403/117; 137/595, 614.04; 280/420, 421, 14.4; 172/47, 40

[56] References Cited

U.S. PATENT DOCUMENTS

| | | | |
|---|---|---|---|
| 3,243,066 | 3/1966 | Gardner et al. . | |
| 3,269,570 | 8/1966 | Wallberg . | |
| 3,279,827 | 10/1966 | Brown | 280/421 |
| 3,512,665 | 5/1970 | Westendorf . | |
| 4,332,094 | 6/1982 | Mieger | 414/723 X |
| 4,345,872 | 8/1982 | Arnold . | |
| 4,355,945 | 10/1982 | Pilch . | |
| 4,480,955 | 11/1964 | Andrews et al. | 414/723 |
| 4,488,850 | 12/1984 | Wernimont | 414/723 |
| 4,545,720 | 10/1985 | Cochran et l. | 414/723 |

FOREIGN PATENT DOCUMENTS

| | | |
|---|---|---|
| 1562682 | 4/1964 | France . |
| 2304726 | 10/1976 | France . |
| 2543188 | 9/1984 | France . |

*Primary Examiner*—Robert J. Spar
*Assistant Examiner*—Donald W. Underwood
*Attorney, Agent, or Firm*—Marmorek, Guttman & Rubenstein

[57] ABSTRACT

The connector comprises a carrier (1) adapted for fitment to a machine and a holder (130) adapted for fitment to a tool or an attachment. The carrier comprises two elongate hollow members (2), each of which contains a slide (11) situated displaceably therein, a chamber (4), which is situated between the hollow members, and displacement structure (15, 27), for displacement of the slides. The connector has connection structure for the interconnection and disconnection of the carrier and holder. The connection structure includes at least one first connection member (131) on the holder engageable with at least one first connection element (120; 113A) on the carrier, and at least one second connection member (133) on the holder engageable with at least one second connection element (113) attached to the slides.

19 Claims, 13 Drawing Sheets

III

II

V

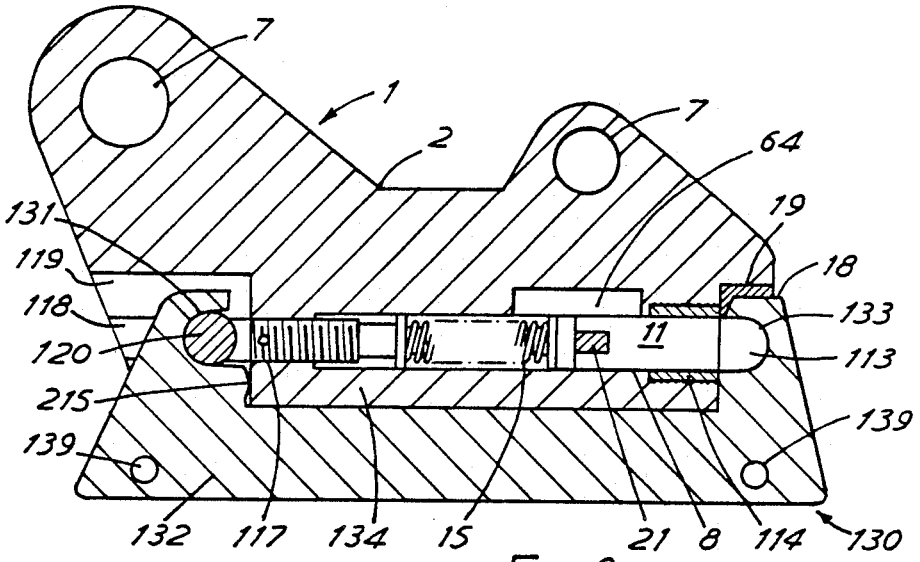
IV FIG. 8
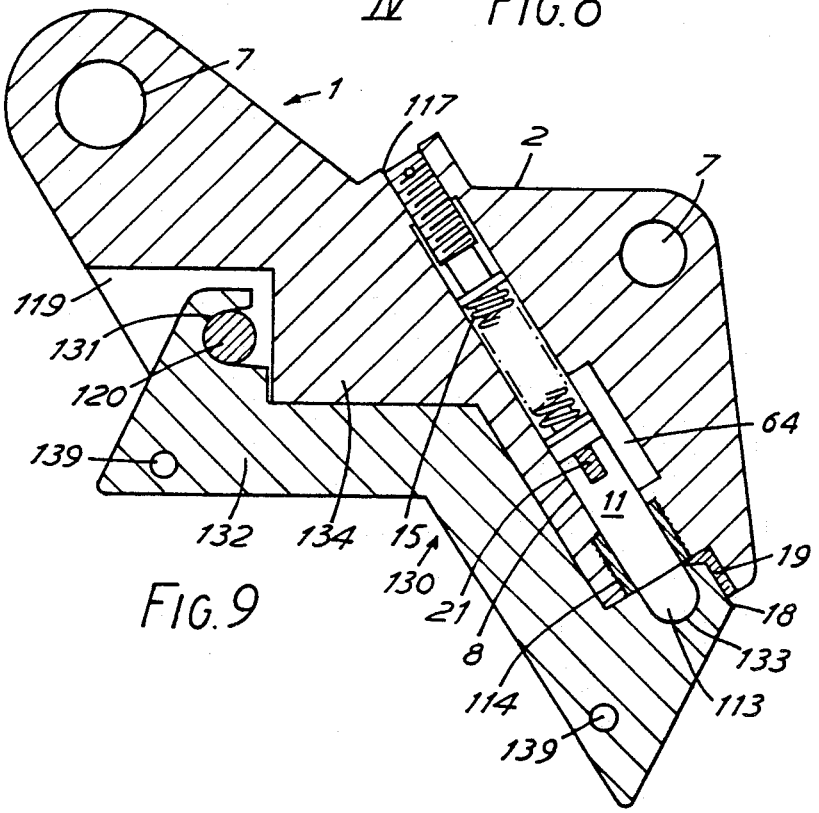
FIG. 9

VI
VII 1
2
63
64
8
15
130
132
137
138
151
152
153
154
155
155A
156
157
158
159
160
161
163
164
165
166
167
168
4
5
6

CONNECTOR

The invention relates to a connector for the connection of an implement, e.g. a tool, such as a bucket or a clamshell, to a machine, e.g. an excavator or for the connection of an attachment member, e.g. front end boom arm and dipper stick to a machine, e.g. an excavator. The connector comprises a carrier associated with the machine and holder associated with the tool or attachment. The connector incorporates remotely controlled means for its connection to the implement or attachment member.

Known connectors have various disadvantages known to persons skilled in the art including the following: they are welded and consequently inaccurate and expensive, they comprise of an open structure for dirt entrapment during operation, the hydraulic services cannot be fully controlled from the operator's cabin and they are not sufficiently universal, versatile or failsafe in use.

The invention provides a connector comprising a carrier adapted for fitment to a machine and a holder adapted for fitment to a tool or an attachment, the carrier comprising two elongate hollow members, each of which contains a slide situated displaceably therein, a chamber, which is situated between the hollow members, and displacement means for displacement of the slides, the connector comprising connection means for the interconnection and disconnection of the carrier and holder, the connection means including at least one first connection member on the holder engageable with at least one first connection element on the carrier, and at least one second connection member on the holder engageable with at least one second connection element attached to the slides.

The aim of the invention is to avoid, or at least to mitigate, these and other disadvantages of known connectors.

This is achieved by a connector having the features claimed in the claims. The invention will now be described, by way of example, with reference to the accompanying diagrammatic drawings, in which:

FIG. 8 is a longitudinal section along line IV—IV in FIG. 4;

FIG. 9 is the same section as in FIG. 8 of another embodiment;

Figure 25:
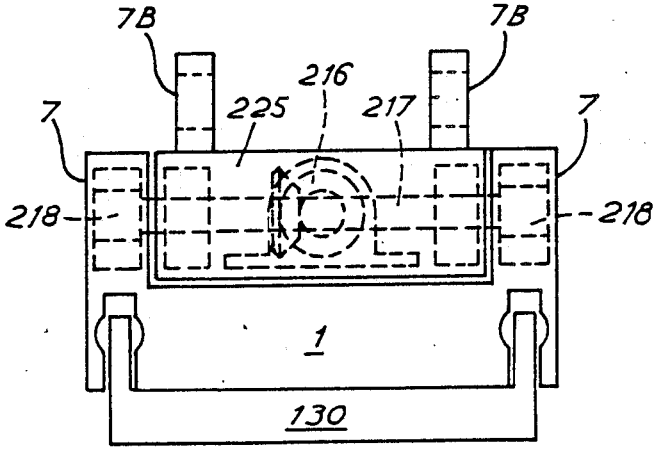

FIG. 25 is a front view of a connector with an auxiliary mounting. The carrier 1 shown inn FIGS. 1 to 10 is fitted in the arm (not shown) of an excavator and can in use assume various positions. It will be described, for the sake of simplicity, as if it were permanently in the horizontal position shown in FIG. 1, using words like "top" and "bottom". The carrier 1 comprises two elongate, mutually parallel lateral members 2 between which is situated a sealed chamber 4 which is delimited by the members 2, a top wall 5, a removable bottom wall 6, a rear end wall 14 and a front end wall 14A. On top of each member 2 are provided two eyes 7 which in all FIGS., except in FIGS. 2 and 3, have a fixed spacing from each other, for the connection of the carrier 1 to the excavator arm and associated linkage. The body of the carrier, which includes the two members 2 and the chambers 4, is, together with the eyes 7, cast in one piece (except for the wall 6). The carrier 1 is substantially symmetrical with respect to a plane passing perpendicularly to the walls 5 and 6 between the lateral members 2.

Figure 2:
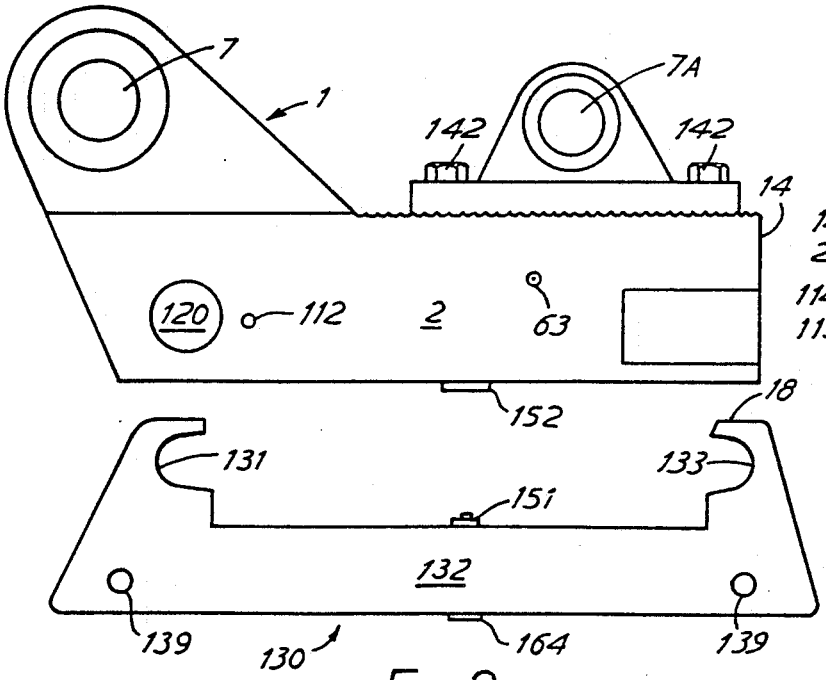
FIG. 2 is a similar embodiment with two displaceable eyes.
Figure 3:
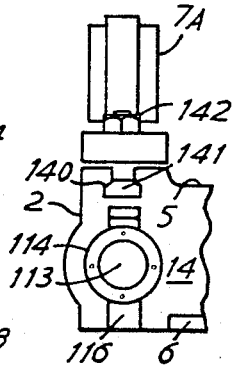
FIG. 3 is a partial end view to FIG. 2.
Figure 4:
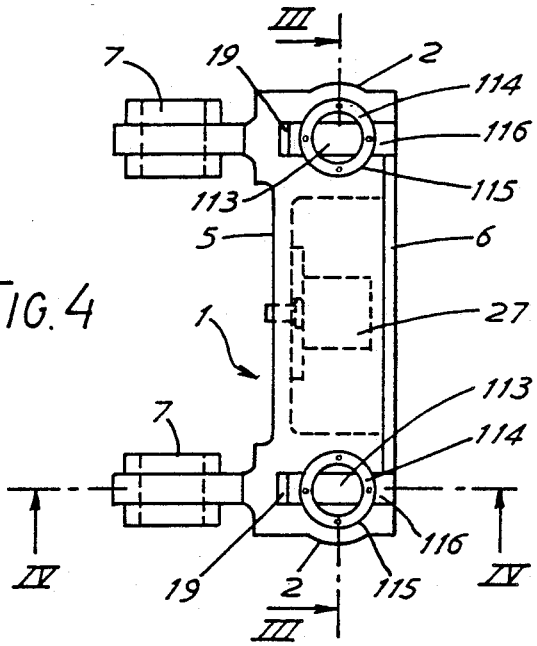
FIG. 4 is an end view to FIG. 1.

Alternatively, the spacing of the eyes may be made adjustable, as shown in FIGS. 2 and 3, so that the carrier may be used with a greater variety of machines. In that embodiment the eye 7A is firmly fixed on, or made integral with, a base plate, the bottom surface of which is serrated and rests on a complementarily serrated portion of the top surface of the associated member 2. The base plate is fixed to the member 2 by bolts 141 which have tapered heads guided in a longitudinal channel 140 and may be fixed in position by nuts 142.

Each member 2 is provided with a substantially cylindrical hole 8 containing a locking device. Each locking device comprises a slidable bar 11 of circular cross-section which is at its outer (rear) end provide with nose 113, defined by two parallel lateral faces and a semi-cylindrical surface between them, and at its inner end biased by a helical compression spring 15 the compression of which is adjustable by a setting device formed by a grease-operated ram 117 the body of which is fixed to the associated member 2 such that its piston rod extends towards the spring 15. The ram 117 is filled, via a nipple 112, with grease under pressure to extend its piston rod. On unscrewing the nipple 112 the pressure exerted by the ram 117 is released. Each bar 11 is lubricated via a chamber 64 supplied with lubricant through a nipple 63.

The rear end of each hole 8 is provided with a coaxial enlargement 115 in which is situated a sealing sleeve 114 which is shorter than the enlargement 115 and is screwed into the shoulder of the enlargement 115 and defines a cylindrical hole forming continuation of the hole 8. In this embodiment each member 2 is sealed by the associated ram 117 and sealing sleeve 114 in conjunction with the relevant bar 11. Diametrically (vertically) across the free portion of the enlargement 115 passes a substantially rectangular slot 116 extending at both ends beyond the enlargement 115. At the rear end of each member 2 is provided a tapered abutment 19 in the form of a replaceable wearing plate which may have a wedge-shaped portion to prevent the holder 130 (described below) from moving longitudinally relative to the carrier 1 and to ensure coaxiality of the coupling parts (described below) in locked position.

The front end of each hole 8 is provided with a coaxial enlargement 118. Diametrically (vertically) across the enlargement 118 passes a substantially rectangular slot 119 extending at both ends beyond the enlargement 118. Fitted inside the enlargement 118 is a replaceable tapered transverse pin 120.

Figure 5:
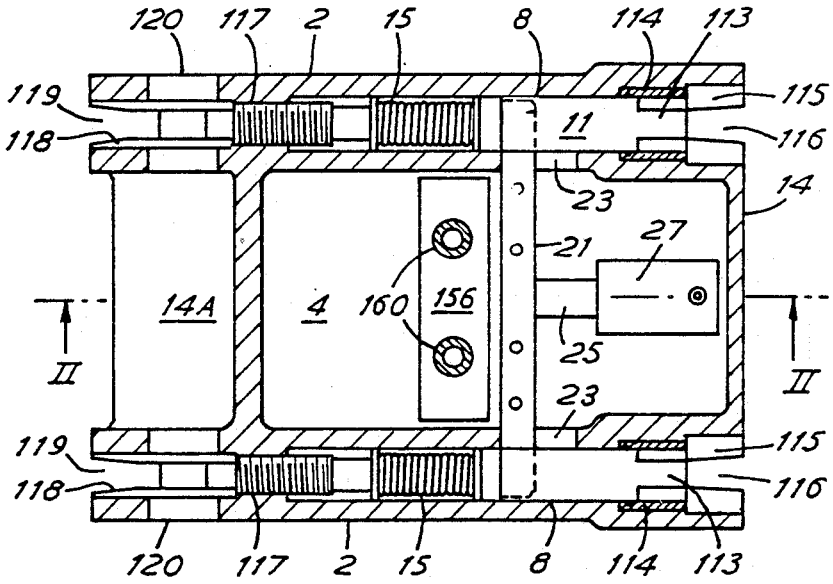
FIG. 5 is a longitudinal section along line III—III in FIG. 4.
Figure 6:
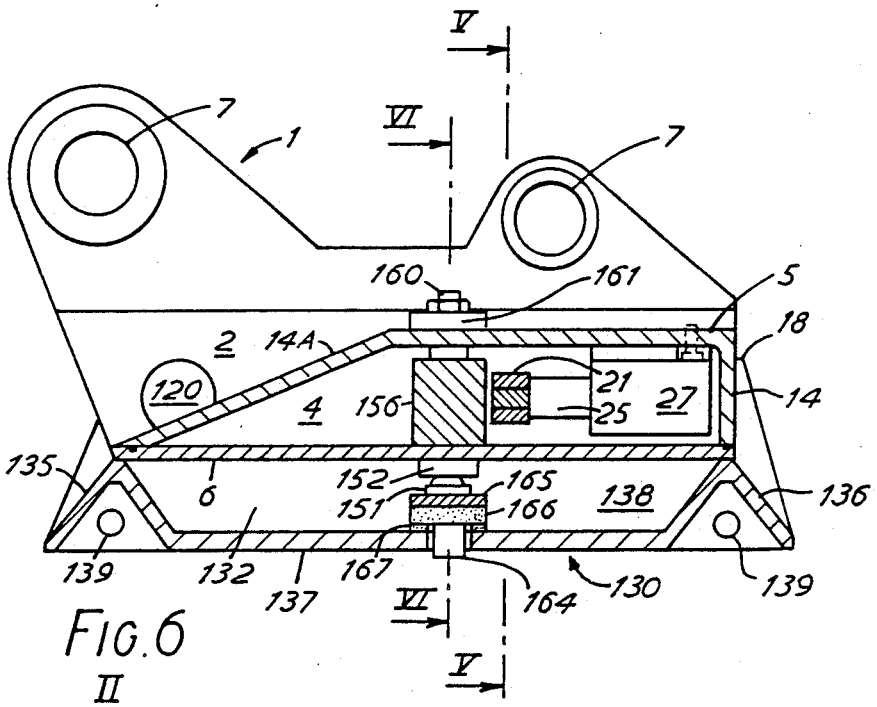
FIG. 6 is a longitudinal section along line II—II in FIG. 5.
Figure 7:
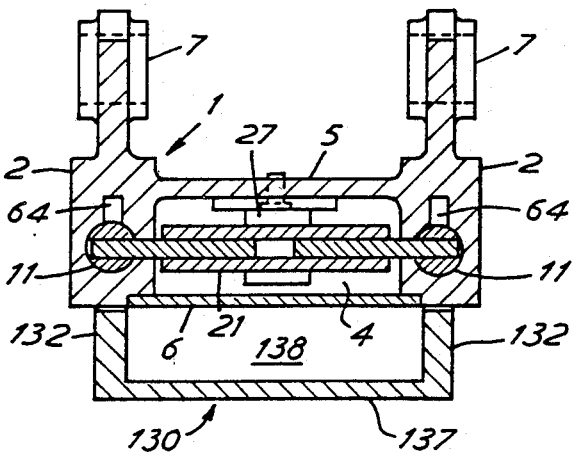
FIG. 7 is a transverse section along line V—V in FIG. 6.

The two bars 11 are interconnected by a transverse link 21 which passes through lateral slots 23. With the central part of the link 21 engages a piston rod 25 of a ram 27. When the piston rod 25 is retracted, the bars 11 are forced by their respective springs 15 to a locked position in which their noses 113 are extended and project into the slots 116, as shown in FIG. 8; when the piston rod 25 is extended, the noses 113 are retracted to an unlocked position in which they are situated inside the holes 8 (inside the sleeves 114), as shown in FIG. 5. As will be apparent from the preceding description, the carrier includes a sealed cavity defined by the chamber 4 and sealed portions of the lateral members 2 communicating with it via the slots 23, the sealing being obtained by the sealingly attached wall 6, the rams 117 and the sleeves 114. The link 21 prevents the bars 11 from rotation.

The tools with which the connector may be used can be divided into passive tools, i.e. tools which cannot perform any movement of their own, such as simple buckets, and active tools, which can perform a movement of their own independently such as ram operated clamshell buckets. The latter have a stationary part which carries one or more movable parts and means for moving them. The passive tool, or the stationary part of an active tool, must be provided with a suitable holder 130 compatible with the carrier 1 of the connector.

The holder 130 illustrated in FIGS. 1, 2, 6, 7, 8 and 10 includes two spaced apart, mutually parallel side walls 132, each of which incorporates a front tapered socket 131 and a rear socket 133. Each of the sockets 131 and 133 is provided with a semicylindrical recess. On top of each rear socket 133 is a face 18 engaging with the abutment 19. The face 18 may be longitudinally grooved to provide registration with a complementarily shaped abutment 19 and thereby to prevent the holder 130 from moving transversely relative to the carrier 1. The side walls 132 are interconnected by a transverse plate 137 having a front apron 135 and a rear apron 136, each of the aprons being substantially inversely V-shaped in cross-section. In the side walls 132, in the area delimited by the aprons 135 and 136, are provided holes 139 for the fixing of the holder 130 to an implement. As is apparent from FIGS. 8 and 9, the lateral portions of the holder 130 and carrier 1 are complementarily shaped so that central parts 134 of the carrier 1 fit between the sockets 131, 133. An important advantage of the holder 130 is that it is also made as a casting and consequently be more accurate, stronger and cheaper than a welded one. Not only is a welded holder subject to distortion but each must be produced individually with obvious consequencies as regards accuracy, time needed for manufacture andd cost.

The holder 130 is attached to the carrier 1 in that first, the front tapered sockets 131 are caused to enter the slots 119 such that their recesses engage the tapered transverse pins 120, and then the rear sockets 133 are caused to enter the slots 116 until the faces 18 of the rear sockets 133 are stopped by the tapered abutments 19, whereupon, by the actuation of the ram 27, the noses 113 are forced into the recesses of the rear sockets 133 whereby the carrier 1 and holder 130 are locked together. When this happens a closed compartment 138 is formed between the carrier 1 and holder 130, the enclosure being obtained by the upper surfaces of the side walls 132 between the sockets 131, 133 sealing against the bottom surfaces of the central parts 134 and by the tops of the aprons 135 and 136 abutting against the bottom wall 6.

FIG. 9 shows an embodiment similar to that shown in FIG. 8 with an angular configuration of the carrier 1 and a complementary configuration of the holder 130. The rear eyes 7 are not only at a different end but also on a different side than the front eyes 7. This has advantages for use with buckets without a flat top. Other elements are substantially the same as those described in connection with FIGS. 1 to 10. Consequently, the described setting device 117 is now positioned between the front and rear eyes 7.

Figure 12:
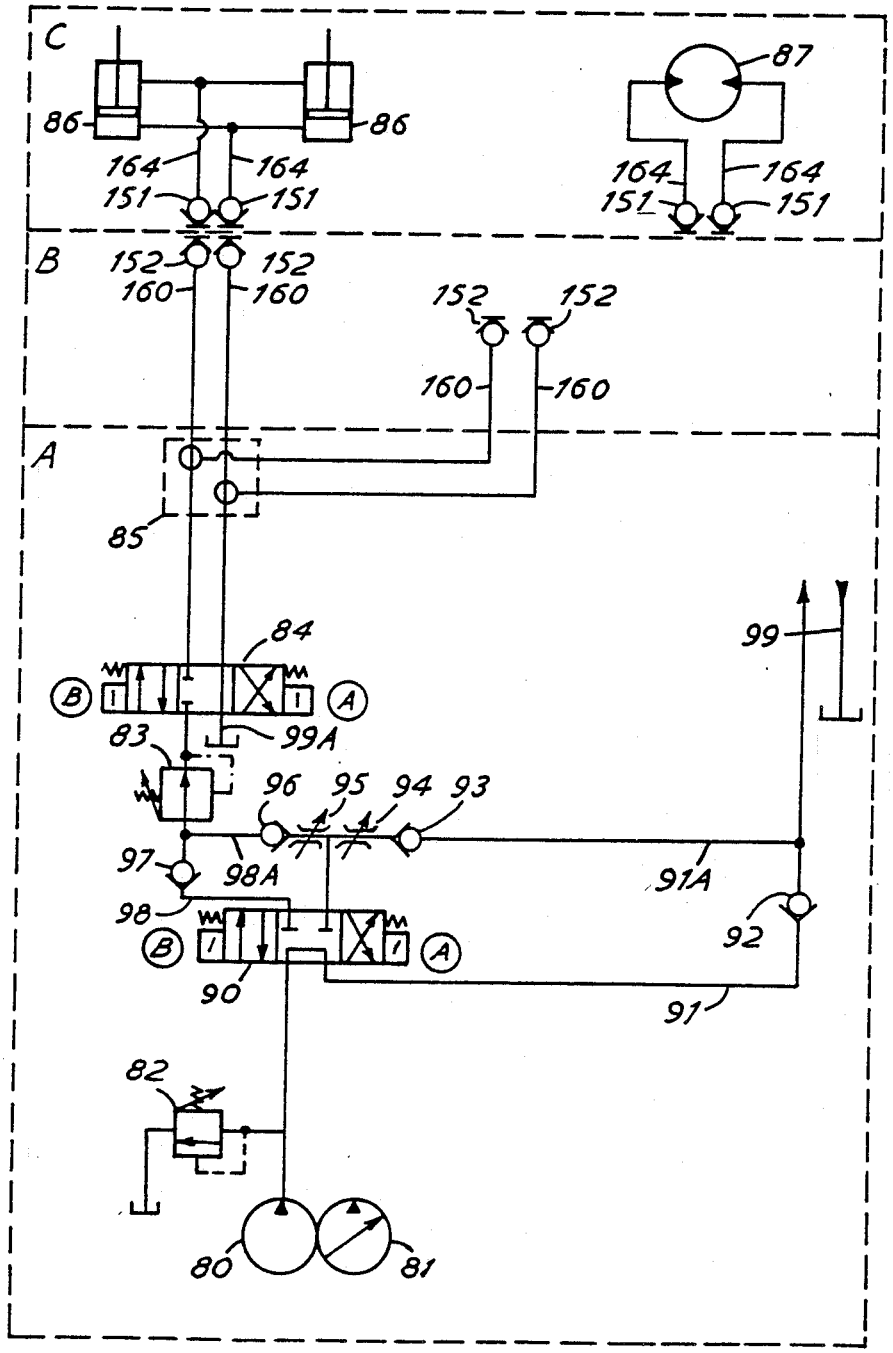
FIG. 12 is a circuit for controlling active tools and an auxiliary circuit of a working equipment.

The connector as described so far can be used for the connection of any passive tool. Naturally, active tools need also a connection to energy-providing and controlling means (in the illustrated example a hydraulic circuit). Consequently the illustrated connector has also means for automatic coupling and uncoupling from a hydraulic circuit (FIG. 12). The coupling means in the just described embodiment include two couplings shown in detail in FIG. 10. Each coupling is composed of a male part 151 and a female part 152. The parts 151, 152 are fitted with respective check valves 153, 154 of the poppet type. The valves 153, 154 close the flow path (not shown) when the parts 151, 152 are uncoupled and establish the flow path as shown when they are coupled.

Figures 10, 11:
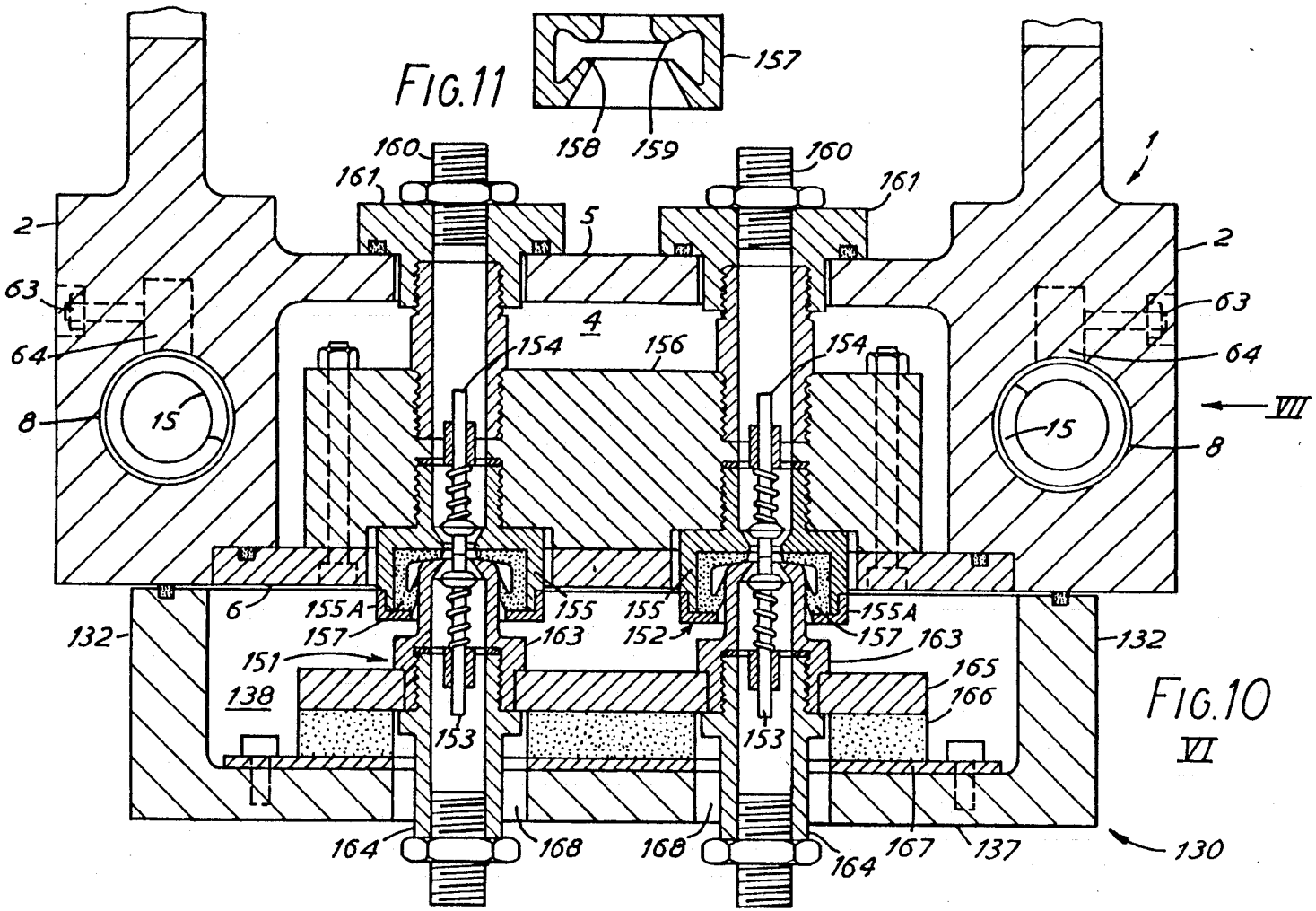
FIG. 10 is a transverse section along line VI—VI in FIG. 6.
FIG. 11 is an axial section through a seal.

Each female part 152 has a body 155 and retaining ring 155A. The bodies 155 of both the female parts 152 are screwed in respective holes in a common block 156 bolted to the bottom wall 6 inside the sealed chamber 4. Inside each body 155 is a compression-wiper seal 157 symmetrical about an axis and having a wiper element 158 and a compression element 149 (FIG. 11). Each female part 152 communicates with an extension pipe 160 passing through a sealing cap 161 fitted in the top wall 5.

Each male part 151 has a body 163 and an extension pipe 164. The body 163 and extension pipe 164 are provided with flanges by which they are fixed to a non-resilient plate 165 carried by a resilient washer 166 which in turn is carried by a non-resilient plate 167 attached by screws to the transverse plate 137. In the plates 167 and 137 is an outsized hole 168 for the extension pipe 164. Alternatively, the flanges of the body 163 and extension pipe 164 can be carried by resilient washers 166 placed on either side of the transverse plate 137.

While the carrier 1 and the holder 130 are connected together the top parts of the bodies 163 enter the respective seals 157 and pass beyond the end of the wiper elements 158, whereupon the check valves 153, 154 contact each other and gradually open. On full opening the bodies 163 compress compression elements 159 of the seals 157. If any oil escapes into the annular cavity between the body 163 and the associated seal 157, the pressure exerted thereby in that cavity presses the wiper element 158 on to the body 163, thus improving the sealing effect.

FIG. 12 shows a hydraulic circuit for controlling rams 86 on a clamshell bucket when the male female parts 151, 152 are coupled together. The circuit is divided by lines into zones A, B and C. Elements in zone A are situated on the machine, those in zone B on the carrier 1, and those in zone C on the holder 130 and tool. The circuit comprises a fixed-displacement pump 80 or a variable-displacement pump 81, relief valves 82, 83, a 3-position directional valve 84, a rotary valve 85 for directing the flow of hydraulic liquid either to rams 86, e.g. of a clamshell bucket, or to a hydraulic motor 87, e.g. for a drill, and a return line 99A leading to the tank. The circuit shown in FIG. 12 includes also a 3-position directional valve 90, a tool feeding line 98 incorporating a check valve 97, a tool feeding line 98A incorporating a flow-control valve 95 and a check valve 96, an auxiliary feeding line 91 incorporating a check valve 92, and a further auxiliary feeding line 91A incorporating a flow-control valve 94. Reference 99 indicates a return line leading to a tank. When the valve 90 is in the illustrated position, hydraulic fluid flows, via line 91, and valve 92 to an auxiliary equipment (not shown) on the machine. When the valve 90 is in B-position, the liquid flows, via line 98 and valves 97, 83 to the valve 84 for controlling double actuation of the rams 86 or motor 87. When the valve 90 is in the A-position the liquid is divided to flow, via 95, 96, 98A, 83, 84 as previously described, and also via 94, 93, 91A. Naturally, the same circuit can be used for arrangement where e.g. further rams are used instead of a motor 87. The 3-position directional valves in the described hydraulic circuits are preferably solenoid-controlled and cab-operated.

The operator's cab comprises a console with controls which include the following: a control switch for actuating the ram 27 to disconnect the carrier 1; 1A/1B; from the holders 130;13A; 130B/130C; a control switch for controlling the valve 84; a control switch for controlling the valve 90.

Figure 19:
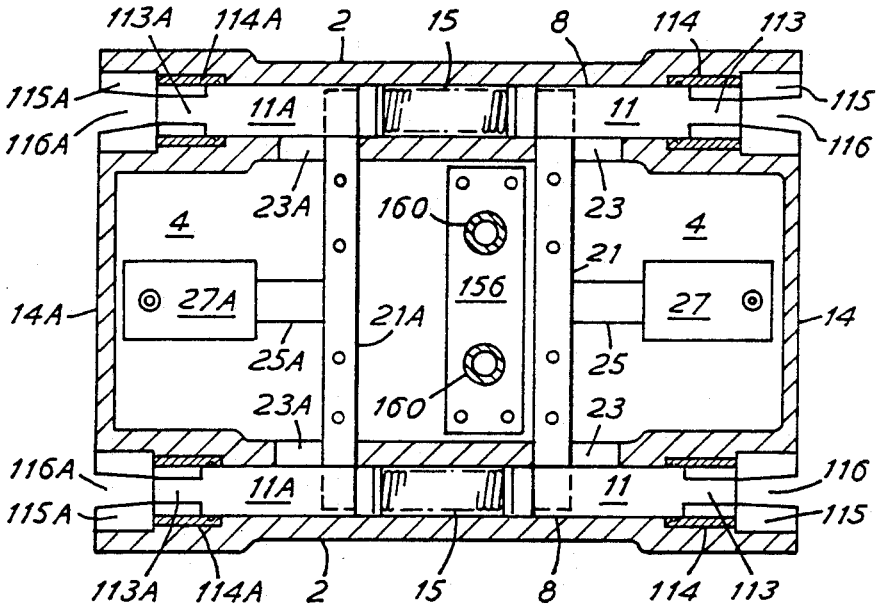
FIGS. 19 and 20 show a further embodiment which is a modification of that shown in FIGS. 5 and 8.

The illustrated and described embodiments can be modified in a number of ways. So, for instance, the ram 27 can be double-acting and used either without the springs 15 or in conjunction therewith. Also two rams could be used instead of a single one, acting either together or opposite to each other (FIG. 19). Alternatively, double-acting rams can be situated in the lateral members 2 to displace the bars 11. In that case the springs 15 and ram 27 and link 21 (or rams 27 and 27A and links 21 and 21A) are not needed. Instead of a hydraulic ram a pneumatic ram or a linear motor, screw and nut drive or a rack and pinion drive can be used. Also instead of the spring 15 a different spring or spring unit, e.g. a series of disk springs, or resilient gas-filled compressible means may be used.

In another embodiment two eyes 7 may be provided at the front, each on one of the lateral members 2, and a single eye 7 provided at the rear centrally on the top wall 5.

Hard-wearing linings acting as a plain bearing may be situated in the cylindrical holes 8 to facilitate sliding of the bars 11 therein.

Also other couplings may be used in place of the described ones, for instance couplings having male and female parts screwed together by rotation of the body 155 of each female part 152. The female parts 152 may contain a butterfly valve and an abutment for depressing the check valve 153. The butterfly valves can be operated by a common shaft carrying a pinion turned by a rack actuated by the ram 27.

Figure 1:
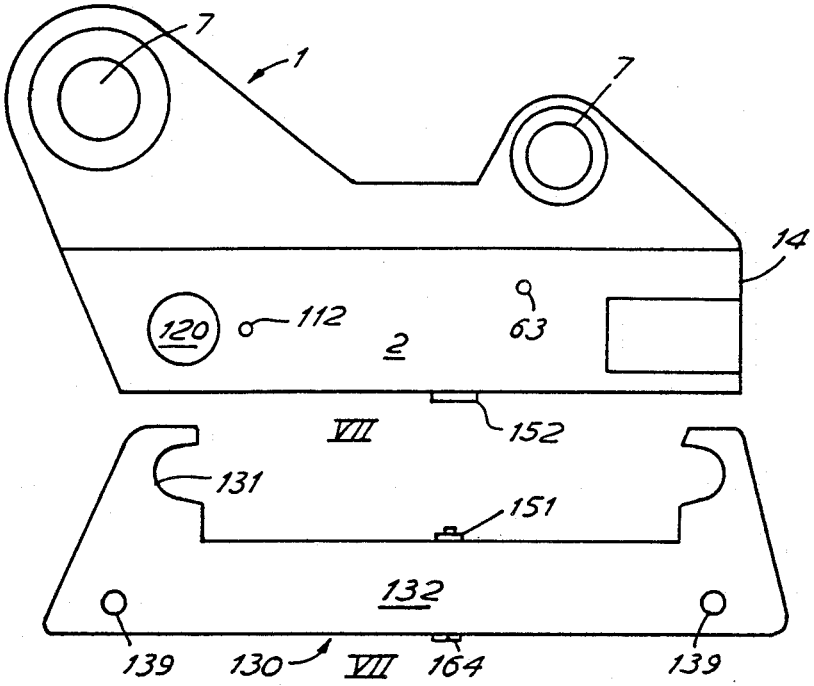
FIG. 1 is a side elevation of a connector comprising a carrier and holder.
Figure 13:
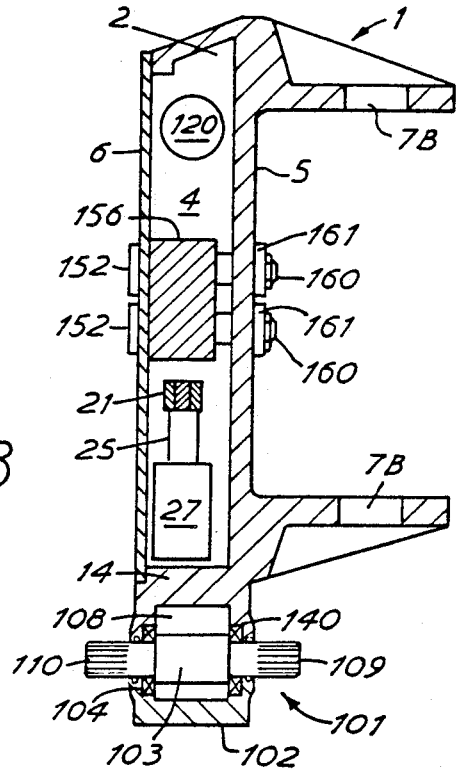
FIG. 13 is a section through a carrier with a drive assembly.

The carrier 1 shown in FIG. 13 has two eyes 7B of the same size positioned "turned" through 90° compared with the embodiment show in FIG. 1. The carrier 1, which has four hydraulic couplings situated in the block 156, includes a drive coupling assembly 101 positioned below the rear end wall 14, although it could also be positioned otherwise, e.g. in a suitably modified chamber 4. The assembly 101 comprises a bearing housing 102 forming continuation of the end wall 14 and supporting a drive shaft 103 with splined ends 109, 110 mounted in bearings 104. Two end caps (not shown) fitted with seals complete the assembly 101 which defines a sealed lubricant chamber 108. The carrier 1 can be connected to the rear part of a pivot-steer chassis of a wheel loader at the point of articulation, while the holder 130 is connected to the front attachment part of the loader so that the drive shaft for driving the wheels of the attachment part can be connected, via the assembly 101, to the gearbox of the engine. Alternatively, one end 109 of the splined drive shaft 103 is connected to a tractor power take-off (known per se) via an extendable shaft (not shown) provided with universal joints at each end to allow the carrier 1 to be raised or lowered by the tractor linkage. Thus the drive coupling assembly 101 can be driven directly by the tractor by engaging the tractor power take-off from the cab. Agricultural equipment can therefore be connectably driven from the other end 110 of the shaft 103.

It will be understood that agricultural equipment which requires to be driven via the tractor power take-off, e.g. straw balers, harrows or rotavators, could be described as "active tools" and as such may be controllably connected to the carrier 1 remotely, as described previously.

As is apparent from the preceding description, the connector has connection means (i.e. remotely controlled means for the connection of the holder 130 to the carrier 1) and coupling means (i.e. means for automatic coupling of the holder 130 to and its uncoupling from a hydraulic circuit), the coupling means being mechanically connected to and controlled by the connection means.

Figure 14:
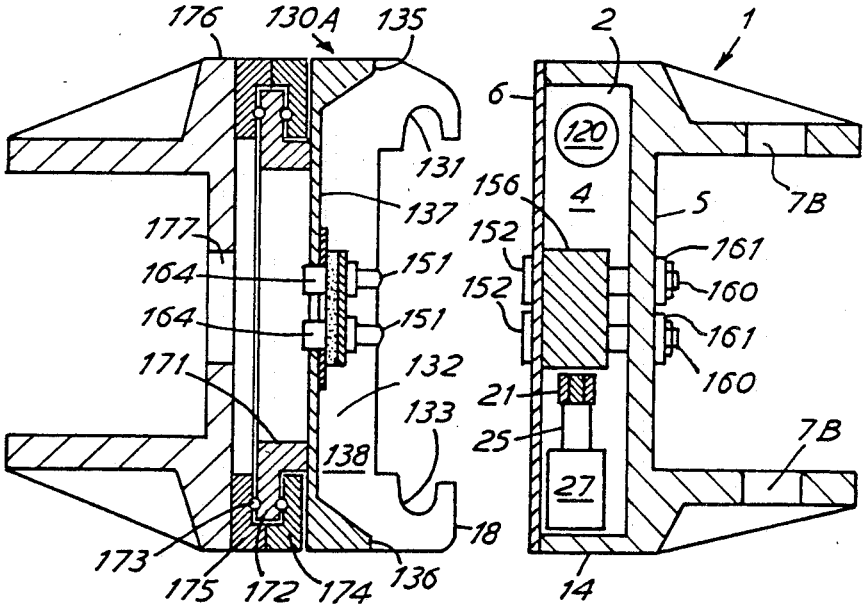
FIG. 14 is a section through a further embodiment of a connector.

FIG. 14 shows a carrier 1 which is the same as the carrier 1 in FIG. 13 except that it has no assembly 101. The associated holder 130A has a transverse plate 137 with two aprons 135, 136 which seal against the bottom wall 6 to define, when the parts 1 and 130A are connected together, a closed compartment 138. Connected to the outer side of the plate 137 is an inner ring 171 with an outer flange 172 with ball races 173 on the opposite sides thereof. The flange 172 carries two outer rings 174, 175 which are bolted together. To the ring 175 is welded an attachment member 176 in which is a hole 177 for hydraulic hoses of the associated hydraulic drives of the attachment. The connection of the attachment member 176 to the holder 130A, via the ring assembly 171 to 175, enables the member 176 to freely turn relative to the holder 130A within limits determined by hydraulic hoses connected to the extension pipes 164 of the male parts 151. The attachment member 176 comprises part of a front end equipment, e.g. a compaction roller front end, a fork lift front end.

Figure 15:
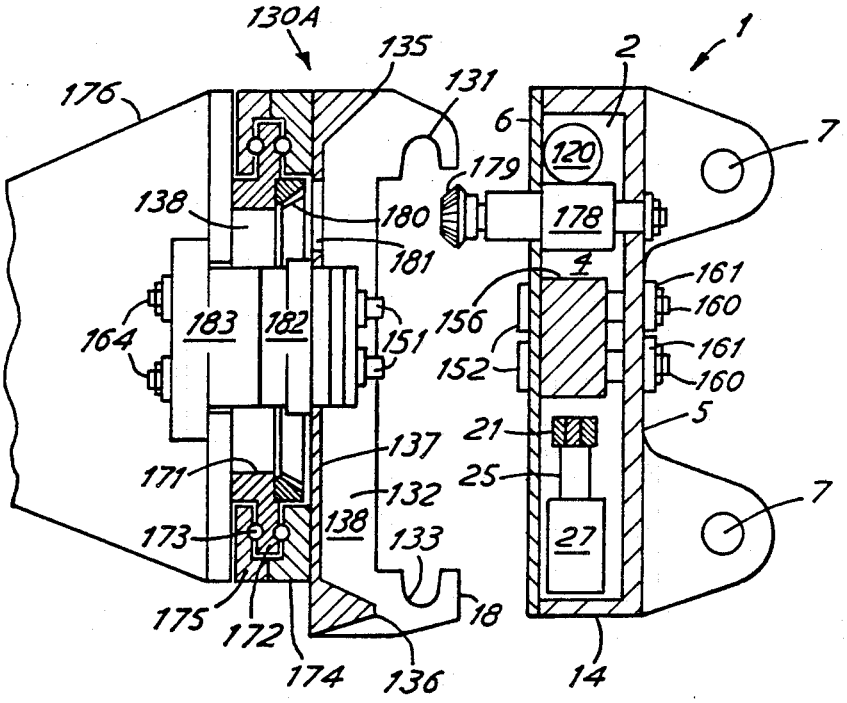
FIG. 15 is a section through a further embodiment of a connector.

FIG. 15 shows a carrier 1 which is substantially the same as that shown in FIG. 14 except that the eyes 7 are "turned" through 90°. Situated within the chamber 4 is a hydraulic motor 178 for driving a bevel gear 179. Also the holder 130A is similar to that described in connection with FIG. 14 except that the outer ring 174 is connected to the plate 137 (in which is a hole 181) and the inner ring 171 to the attachment member 176. A toothed ring 180 is connected to the inner ring 171. In the holder 130A is axially situated a hydraulic rotary joint with a plurality of flow paths. One part 182 of the joint is connected to the plate 137 and the other part 183 is connected to the attachment member 176 so that the latter can rotate relative to the holder 130A unimpeded by hydraulic hoses. The male parts 151 and the associated mounting washers 166 are attached to the part 182. On connection of the holder 130A to the carrier 1, the bevel gear 179 enters through the hole 181 and engages with the toothed ring 180. The attachment member 176 comprises part of an implement attachment, e.g., a reversible plough or a cultivator.

Figure 16:
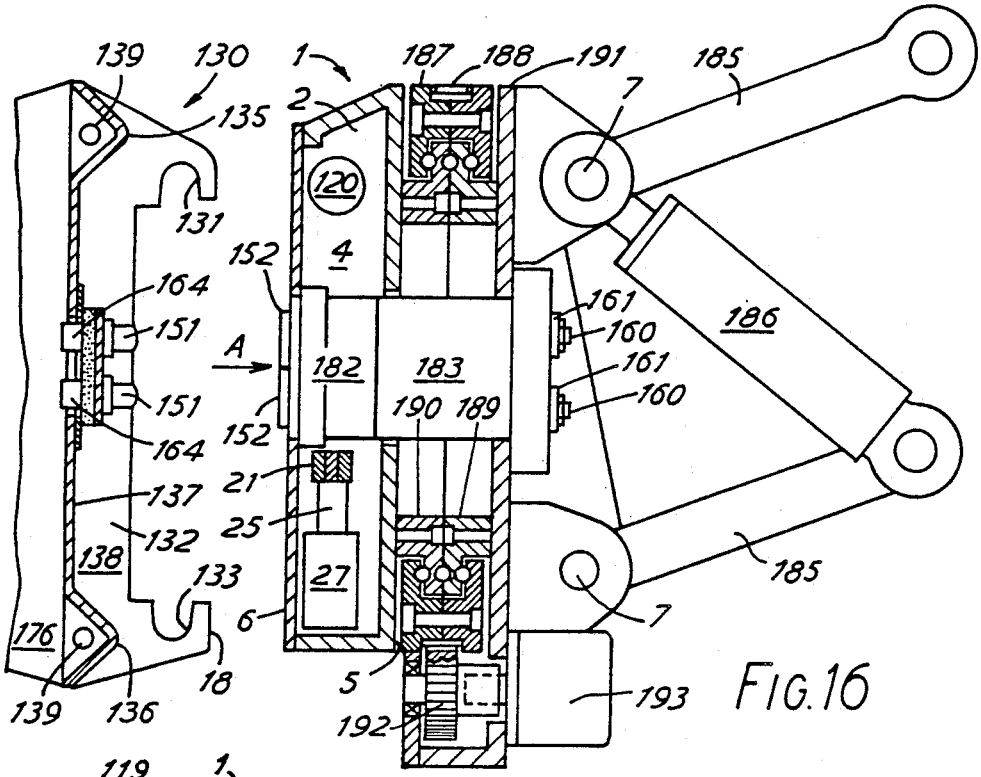
FIG. 16 is a section through a further embodiment of a connector.
Figure 17:
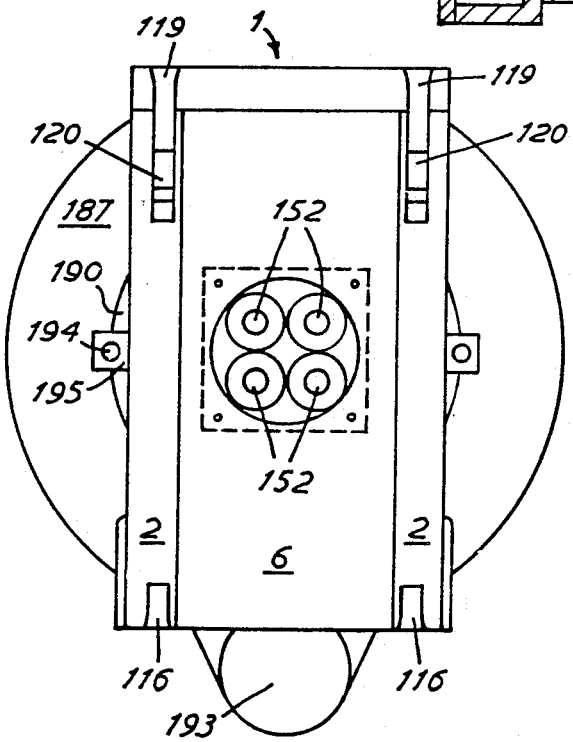
FIG. 17 is a view along the arrow A in FIG. 16.

FIGS. 16 and 17 show an embodiment in which the carrier 1 incorporates a rotary mechanism situated between the top wall 5 of the chamber 4 and the eyes 7 to which is connected a parallelogram linkage. The linkage arms 185 are connected to a tractor and a linkage ram 186 serves to vertically displace the carrier 1. The rotary mechanism contains an outer ring 187 formed by two interconnected ring-shaped elements bolted together and provide at their outer periphery with a toothed ring 188 composed of segments which are retained within a circumferential groove formed in the ring 187. Within the outer ring 187 are situated inner rings 189, 190. The ring 189 is fixed to a plate 191 carrying the eyes 7 and is therefore always stationary. The ring 190 is fixed to the top wall 5 and is always rotatable relative to the ring 189. Ball races are provided in the interfaces of the rings 187, 189, 190 to allow their rotation relative to each other. With the toothed ring 188 meshes a pinion 192 driven by a motor 193. Semi-cylindrical grooves are formed in the circumferential interfaces of the rings 187, 190 which, when aligned, define two diametrally opposite holes into which enter locking pins 194 each situated in a housing 195 connected to the carrier 1. Each pin 194 is actuated by actuating means (not shown). When the ring 190 is not locked by the pins 194 to the ring 187, the ring 190 is freely rotatable relative to the ring 189 (and also to the ring 187). When the ring 190 is locked to the ring 187 it rotates therewith when the latter is driven by the motor 193 via the pinion 192 engaging with the ring 188. Centrally positioned within the rotary mechanism is a hydraulic rotary joint comprising two parts 182, 183 of which part 183 is connected to the plate 191 and the part 182 to the bottom wall 6 of the carrier 1. The design and operations of the holder 130 will be understood from the preceding description.

Figure 18:
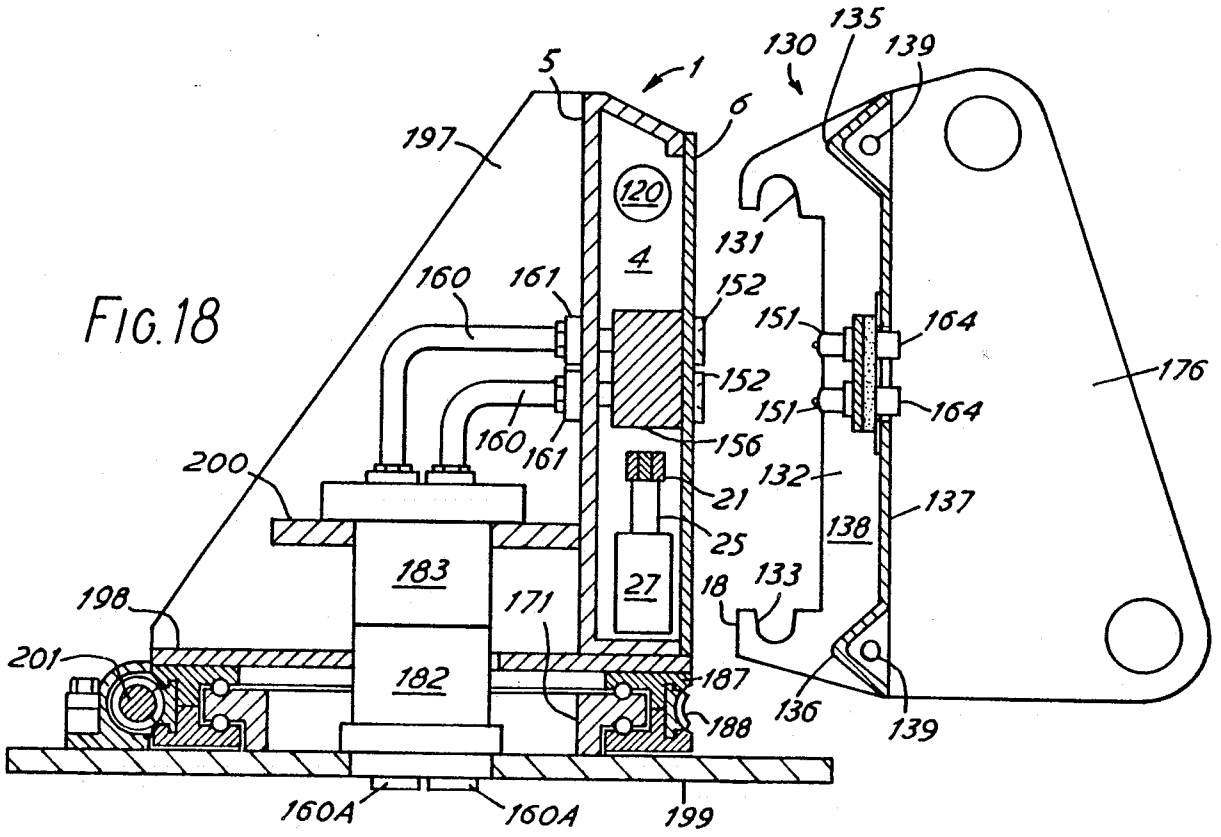
FIG. 18 is a section through a further embodiment of a connector.

FIG. 18 shows a vertically mounted carrier 1 which carries two side plates 197 and a bottom plate 198. To the latter is attached an outer ring 187 formed as described in connection with FIG. 16. Inside the outer ring 187 is situated an inner ring 171 to which is fixed a base plate 199. Fixed to the base plate 199 and to a transverse plate 200, situated between the two side plates 197, are the parts 182, 183 of a hydraulic rotary joint, the latter being connected by pipes to the hydraulic parts in the block 156. On the outer periphery of the outer ring 187 is a toothed ring 188 made of segments with which meshes a worm wheel 201 driven by a motor (not shown) fixed to the base plate 199. The design and operation of the holder 130 are similar to those which have already been described, the attachment member 176 comprising part of a boom attachment, e.g. a crane jib, drill rig or backacter arm.

Figure 20:
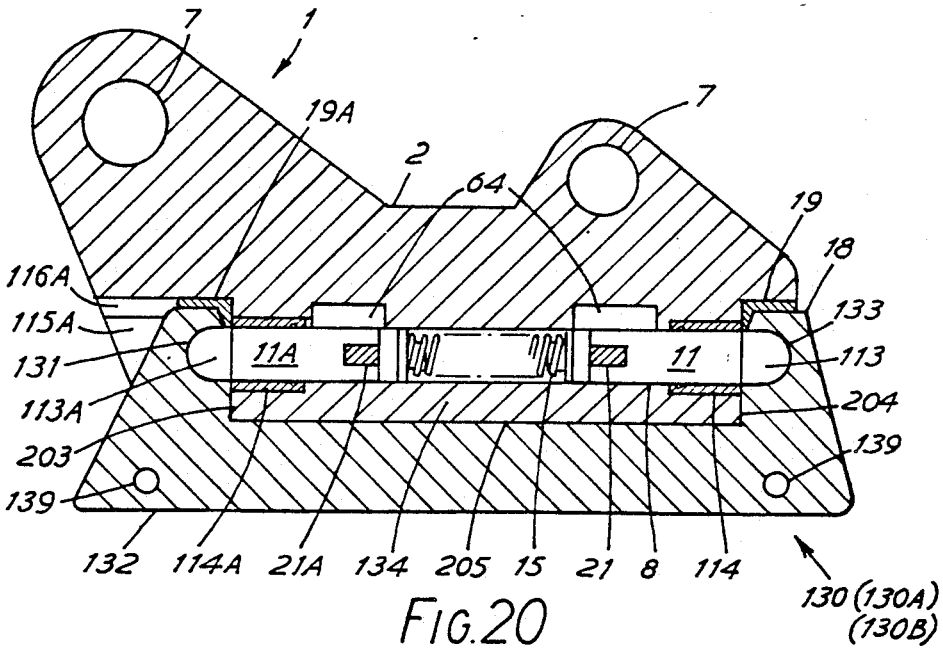

FIGS. 19 and 20 show a modification of the embodiment shown in FIGS. 5 and 8. This embodiment has no rams 117 and no pins 120. The front part of the carrier according to this embodiment is substantially a mirror image of the rear part of the carrier shown in FIGS. 5 and 8. This means that the front part of the lateral members 2 has an enlargement 115A comprising a sealing sleeve 114A and a slot 116A through the enlargement 115A and in the front part of the members 2 are situated further bars 11A, each provided with a nose 113A. The bars 11A are interconnected by a transverse link 21A passing through slots 23A and actuated by the piston rod 25A of a ram 27A, the ram 27 and 27A being hydraulically interconnected. Also further abutments 19A are provided. The arrangement is such that the substantially rectangular central part 134 snugly fits into the substantially rectangular space defined by inwardly facing faces 203, 204 of the sockets 131, 133 and the upper face 205 of the side wall part between them. In this embodiment the carrier 1 is inserted into the holder 130 along a rectilinear path rather than an arcuate one and locked in position by the bars 11, 11A. The faces 203, 204 preferably slightly converge downwardly. It will be understood that the links 21, 21A can be displaced by a single ram having two opposed piston rods 25, 25A simultaneously extendable and retractable or rotatable to displace bars 11, 11A via cams instead of springs 15.

Other embodiments are possible. For instance instead of using springs 15 for the bars 11, 11A a spring means may be situated in the chamber 4 so as to act e.g. centrally on the transverse links 21, 21A. In another embodiment the noses 113A, 113 and sockets 131, 133 may be non-circular e.g. tapered to guide each male part 151 into the associated female part 152 with a smaller deviation of the axis of the former from that of the latter. Suitable guide means comprising a cam on walls 132 indicated at 215 (FIG. 8) may be used for the same purpose. Instead of the check valves 154 the female parts 152 may be provided with a spool valve each, the movable parts of which are displaced perpendicularly to the axes of the female parts 152 and are operated by a solenoid to open and by a spring to close. The solenoid is automatically triggered e.g. by a switch actuated on complete contact beween the carrier 1 and holder 130. Instead of the hydraulic displacement of the transverse links 21, 21A the links may be displaced pneumatically, electrically or mechanically. A tapped through hole may be provided in each front socket 131 and rear socket 133 substantially axially with the bar 11 when received in the recess. This enables, on screwing from outside a screw in the tapped hole, to force the noses 113, 113A out of the recess in the event that the transverse links 21, 21A cannot be actuated or in the embodiment (described earlier) when double-acting rams are situated in the lateral member 2.

It will be further understood that the holder 130, 130A forms an integral component part between the carrier part and attachment member parts for versatility and interchangeability.

FIGS. 21 to 25 illustrate three embodiments of a connector adapted for imparting vibration to a tool.

Figure 21:
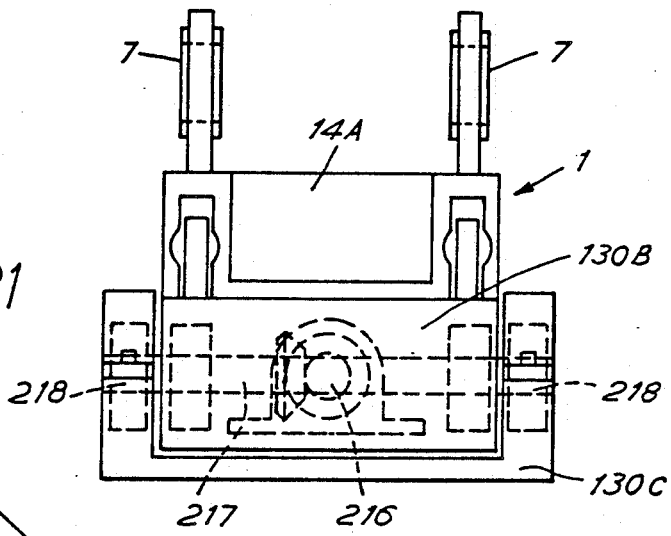
FIG. 21 is a front view of a connector with a two-part holder.
Figure 22:
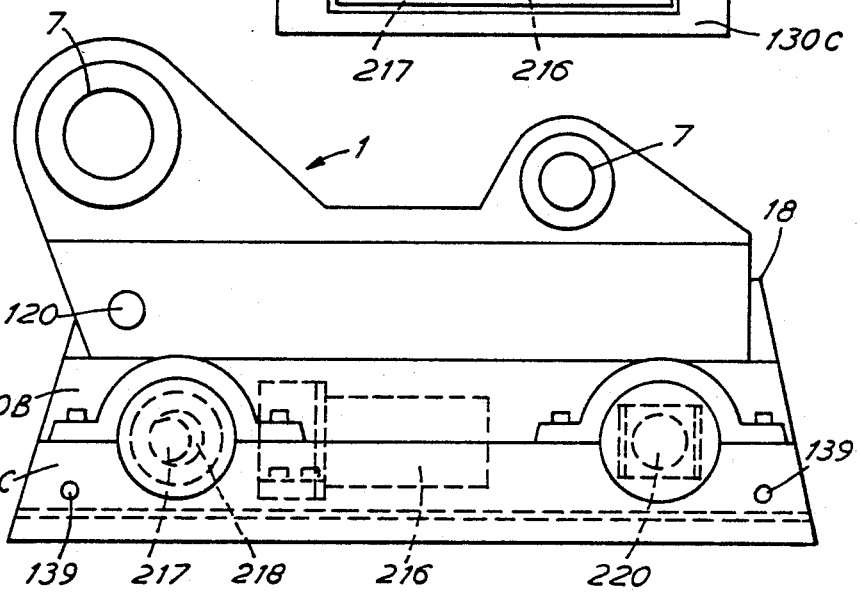
FIG. 22 is a side view to FIG. 21.
Figure 23:
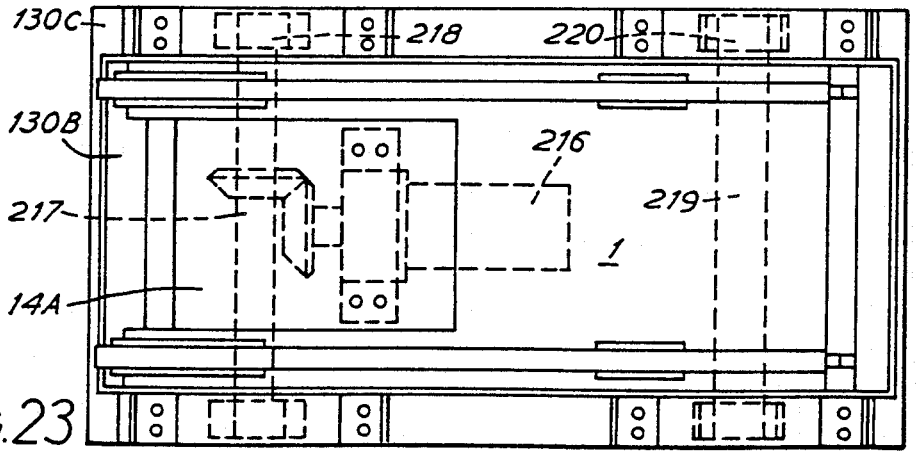
FIG. 23 is a plan to FIGS. 21 and 22.

The first embodiment, illustrated in FIGS. 21–23, comprises a carrier 1 of the type described earlier and a two-part holder formed by a top part 130B and a bottom part 130C. The top part 130B is connectable to the carrier 1 in a manner described earlier. The top part 130B contains a constant-power motor 216 which via a bevel gearing drives a first transverse shaft 217 situated in the front portion of the top part 130B and extending on both sides from its body and provided on each side with an eccentric 218. In the rear portion of the top part 130B is provided a second transverse shaft 219 which also projects on both sides from the body of the top part 130B and is on each side provided with a journal 220. On the eccentrics 218 and the journals 220 is by means of its eyes suspended the bottom part 130C of the holder. In view of this arrangement, when the motor 216 rotates the bottom part 130C vibrates relative to the top part 130B. For this purpose the eccentrics 218 are mounted in fixed bearings while the journals 220 are mounted in slidable bearings.

Figure 24:
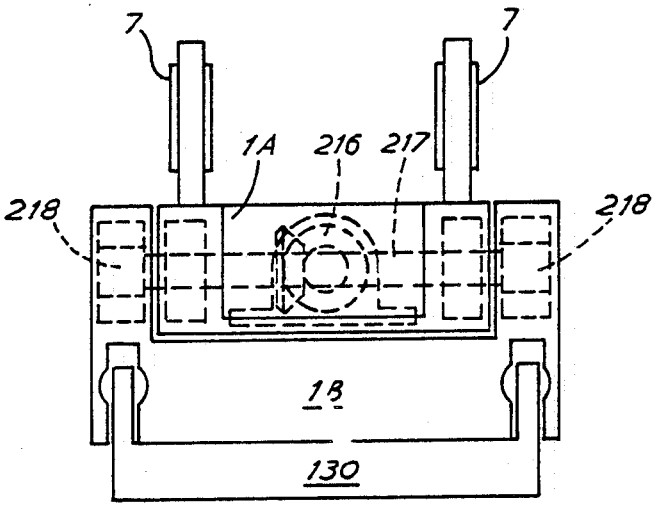
FIG. 24 is a front view of a connector with a two-part carrier.

The second embodiment illustrated in FIG. 24 differs from the first embodiment in that here the connector has a holder 130 as described at the beginning of the specificaton whereas the carrier consists of two parts namely a top part 1A and a bottom part 1B. The top part 1A is provided with lugs and eyes 7 of the type described earlier. The top part 1A of the carrier is provided with a motor 216 and shafts arranged substantially as described in connection with the top part 130B of the first embodiment, and the bottom part 1B is arranged and suspended substantially as described in connection with the bottom part 130C of the first embodiment.

The third embodiment (FIG. 25) comprises a carrier 1 and a holder 130 substantially as described at the beginning of the specification except that the eyes 7 are slightly modified to contain fixed bearings at the front and slidable bearings at the rear as described in connection with the first embodiment. In this embodiment the carrier 1 is provided with an auxiliary mounting 225 which contains a motor and two transverse shafts substantially as described in connection with the top part 130B of the first embodiment. The auxiliary mounting is provided with eyes arranged substantially like the eyes 7B in the carrier described at the beginning of the specification by means of which it can be attached to a machine.

I claim:

1. A connector for attaching a tool or an attachment to a machine, comprising a carrier adapted for fitment to said machine, and a holder adapted for fitment to said tool or attachment, the carrier comprising first and second elongate hollow members having first and second slides situated displaceably therein, a chamber within said carrier which chamber is situated between the hollow members, and displacement means connected to said slides for displacement of the slides, the connector further comprising connection means disposed on said carrier and said holder for the interconnection and disconnection of the carrier and holder, the connection means including two first connection members on the holder engageable with two first connection elements on the carrier, and two second connection members on the holder engageable with two second connection elements attached to the slides, wherein the chamber is substantially closed, and each said hollow member has a portion which communicates, via a slot, with the chamber, whereby a substantially closed cavity is defined in the carrier, and the displacement means include spring means, biasing the slides to a position in which the second connection elements are interlocked with the second connection members, and a displacer situated in the chamber and associated with a link member which extends from the chamber through the slots into the hollow members and interconnects said slides such that the slides are, via the link member, simultaneously displaceable against the force of the spring means.

2. A connector according to claim 1, wherein the holder comprises an attachment member connected thereto by a bearing.

3. A connector according to claim 2, further comprising a drive for rotating the attachment member relative to the holder, the drive including a gear transmission situated inside an extension of said closed compartment.

4. A connector according to claim 3, wherein a coupling means passes through a rotary joint with a plurality of flow paths situated between the holder and attachment member.

5. A connector according to claim 1, wherein the carrier includes a bearing between a main part of the carrier and its part adapted for fitment to a machine, whereby the main part is rotatable relative to the adapted part.

6. A connector according to claim 5, further comprising a drive for rotating the main part of the carrier via a gear transmission when a locking mechanism between the main part and the part adapted for fitment is engaged.

7. A connector according to claim 1 wherein the carrier includes an independently drivable transmission shaft.

8. A connector according to claim 1 wherein the carrier is adapted for fitment to a machine by being provided with spaced-apart eyes, the mutual spacing of the eyes being either fixed or adjustable.

9. A connector according to claim 1 wherein one of the holder and the carrier is formed by two separate interconnecting parts and provided with means for vibrating one of said parts relative to the other.

10. A connector according to claim 1 wherein the carrier is provided with an auxiliary mounting interconnected between two parts of the carrier and with means for vibrating one of the parts relative to the auxiliary mounting.

11. A connector according to claim 1 wherein each said hollow members contains separate displacement means for the displacement of the slide or slides situated therein.

12. A connector according to claim 1, wherein the carrier and holder are casting which are so shaped and dimensioned that, when they are connected to each other, they define between them a substantially closed compartment.

13. A connector according to claim 1 comprising coupling means formed by at least one coupling, each said coupling including a pair of associated parts situated between the interconnected carrier and holder, one of said associated parts being carried by the carrier and the other by the holder, the associated parts being so designed and situated that they are coupled together when the carrier and holder are interconnected, and uncoupled when the carrier and holder are disconnected, the associated parts, when coupled, establishing a flow path between the holder and the carrier.

14. A connector according to claim 13, wherein the flow path is hydraulic and each of the associated parts incorporates a valve.

15. A connector according to claim 13, wherein the flow path is pneumatic and each of the associated parts incorporates a valve.

16. A connector according to claim 13 wherein each pair of associated parts includes a male part and a female part, sealing means being provided, whereby the associated parts are sealingly interconnected when coupled.

17. A connector according to claim 14 comprising a hydraulic circuit for remote actuation of drives for active tools.

18. A connector according to claim 13 wherein one of the associated parts of each coupling which is carried by the holder is carried by a resilient member so that it is tiltable to facilitate its coupling with the other associated part.

19. A connector according to claim 1 wherein the first connection element and the first connection member and contact faces on the carrier and holder, are shaped to mutually interengage so as to prevent movement of the interconnected carrier and holder relative to each other.

* * * * *